US010749317B2

(12) United States Patent
Akimoto

(10) Patent No.: US 10,749,317 B2
(45) Date of Patent: Aug. 18, 2020

(54) IGNITION COIL FOR INTERNAL COMBUSTION ENGINE

(71) Applicant: DENSO CORPORATION, Kariya, Aichi-pref. (JP)

(72) Inventor: Katsunori Akimoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 16 days.

(21) Appl. No.: 16/197,424

(22) Filed: Nov. 21, 2018

(65) Prior Publication Data

US 2019/0165549 A1 May 30, 2019

(30) Foreign Application Priority Data

Nov. 24, 2017 (JP) ..... 2017-226218

(51) Int. Cl.

| | |
|---|---|
| ***H01T 13/44*** | (2006.01) |
| ***H01T 13/05*** | (2006.01) |
| ***F02P 3/04*** | (2006.01) |
| *F02P 3/02* | (2006.01) |
| *F02P 7/02* | (2006.01) |

(52) U.S. Cl.

CPC ..... *H01T 13/44* (2013.01); *F02P 3/04* (2013.01); *H01T 13/05* (2013.01); *F02P 3/02* (2013.01); *F02P 7/02* (2013.01)

(58) Field of Classification Search

CPC .. H01T 13/44; H01T 13/05; F02P 3/04; F02P 7/02; F02P 3/02

See application file for complete search history.

(56) References Cited

U.S. PATENT DOCUMENTS

| | | | | |
|---|---|---|---|---|
| 7,036,495 | B1 | 5/2006 | Shimizu | |
| 2017/0016422 | A1* | 1/2017 | Akimoto | H01F 38/12 |
| 2017/0040104 | A1* | 2/2017 | Akimoto | F02P 3/02 |
| 2017/0321648 | A1* | 11/2017 | Sano | H01F 38/12 |
| 2019/0165550 | A1 | 5/2019 | Akimoto | |

FOREIGN PATENT DOCUMENTS

| | | |
|---|---|---|
| JP | 2002-050528 | 2/2002 |
| JP | 2011-100758 | 5/2011 |
| JP | 2014-022602 | 2/2014 |
| JP | 2014-022603 | 2/2014 |
| JP | 2014-022604 | 2/2014 |
| JP | 2017-098462 | 6/2017 |

* cited by examiner

*Primary Examiner* — Joseph J Dallo

(74) *Attorney, Agent, or Firm* — Nixon & Vanderhye P.C.

(57) ABSTRACT

An ignition coil for internal combustion engines is provided which includes a primary coil, a secondary coil, a case, a high-voltage terminal, a resistor, and a filled resin. The case has a case body and a high-voltage terminal extending downward from the case body. The high-voltage terminal is press-fit in the high-voltage tower to close the inside thereof. The resistor is fit in the high-voltage terminal. The high-voltage terminal includes a pressed wall and a non-pressed wall. The pressed wall is pressed against the high-voltage tower. The non-pressed wall is not pressed against the high-voltage tower. The resistor is fit in the non-pressed wall. This structure minimizes pressure exerted on the resistor and the high-voltage tower to secure a desired degree of durability of the resistor and the high-voltage tower.

11 Claims, 6 Drawing Sheets

IGNITION COIL FOR INTERNAL COMBUSTION ENGINE

CROSS REFERENCE TO RELATED DOCUMENT

The present application claims the benefit of priority of Japanese Patent Application No. 2017-226218 filed on Nov. 24, 2017, the disclosure of which is incorporated herein by reference.

BACKGROUND

1 Technical Field

This disclosure relates generally to an ignition coil for internal combustion engines.

2 Background Art

Japanese Patent First Publication No. 2006-269613 teaches an ignition coil for internal combustion engines which is equipped with a primary coil, a secondary coil magnetically connected to the primary coil, a resistor working to eliminate noise arising from electrical discharge in a spark plug, and a case. The case includes a case body in which the primary and secondary coils are disposed and a cylindrical high-voltage tower extending downward from the case body.

The high-voltage tower has a high-voltage output terminal press-fit therein. The high-voltage output terminal has formed in an upper end thereof a recess in which the resistor is press-fit.

The ignition coil, as taught in the above publication, has the whole of the high-voltage output terminal press-fit in the high-voltage tower. The resistor is, as described above, press-fit in the recess of the high-voltage output terminal. This may result in a risk that an excessive pressure is exerted by the high-voltage output terminal on both the resistor and the high-voltage tower, which leads to concern about a decrease in durability of the resistor and the high-voltage tower.

SUMMARY

It is an object of this disclosure to provide an ignition coil for internal combustion engines which is configured to reduce pressure acting on a resistor and a high-voltage tower.

According to one aspect of the disclosure, there is provided an ignition coil for an internal combustion engine which comprises: (a) a primary coil and a secondary coil which are magnetically coupled with each other; (b) a case which includes a case body in which the primary and secondary coils are disposed and a high-voltage tower which is of a hollow cylindrical shape and extends downward from the case body; (c) a high-voltage terminal which is press-fit in the high-voltage tower to close an inside of the high-voltage tower, the high-voltage terminal being of a hollow cylindrical shape with a bottom and an upper opening facing upward; (d) a resistor which is fit in the high-voltage terminal; and (e) a filled resin which is disposed inside the case body and hermetically seals the primary and secondary coils.

The high-voltage terminal includes a pressed wall and a non-pressed wall which are arranged adjacent each other in a vertical direction. The pressed wall is pressed against the high-voltage tower. The non-pressed wall is not pressed against the high-voltage tower.

The resistor is fit in the non-pressed wall.

The ignition coil, as described above, has the high-voltage terminal which has the pressed wall occupying a portion of a length thereof extending in the vertical direction. The pressed wall is pressed against the high-voltage tower. The high-voltage terminal is press-fit at the pressed wall in the high-voltage tower, so that it is firmly retained by the high-voltage tower. The high-voltage terminal also has the non-pressed wall discrete from the pressed wall in the vertical direction. The resistor 4 fit in the non-pressed wall. This minimizes pressure which results from the press-fit of the high-voltage terminal in the high-voltage tower and acts on the resistor. This enables a length of the pressed wall press-fit in the high-voltage tower to be increased in the vertical direction, which results in an increase in area of contact between the high-voltage tower and the high-voltage terminal. The pressed wall which has an increased area is, therefore, capable of bearing the pressure exerted by the high-voltage tower on the high-voltage terminal, thereby ensuring a desired mechanical strength of the high-voltage tower and the high-voltage terminal. Further, the increased area of contact between the high-voltage tower and the high-voltage terminal enhances the degree of hermetical sealing between the high-voltage tower and the high-voltage terminal, thereby minimizing the leakage of the filled resin from the case.

The resistor is, as described above, fit in the non-pressed wall, not the pressed wall, thereby eliminating the need for increasing a mechanical strength of a structural combination of the pressed wall of the high-voltage terminal and the resistor, which avoids exertion of a large degree of pressure from the pressed wall on the high-voltage tower.

As apparent from the above discussion, the ignition coil is capable of decreasing pressure acting on the resistor and the high-voltage tower.

In this disclosure, symbols in brackets represent correspondence relation between terms in claims and terms described in embodiments which will be discussed later, but are not limited only to parts referred to in the disclosure.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

First Embodiment

The ignition coil 1 for internal combustion engines according to the first embodiment will be described below with reference to FIGS. 1 to 5.

Figure 1:
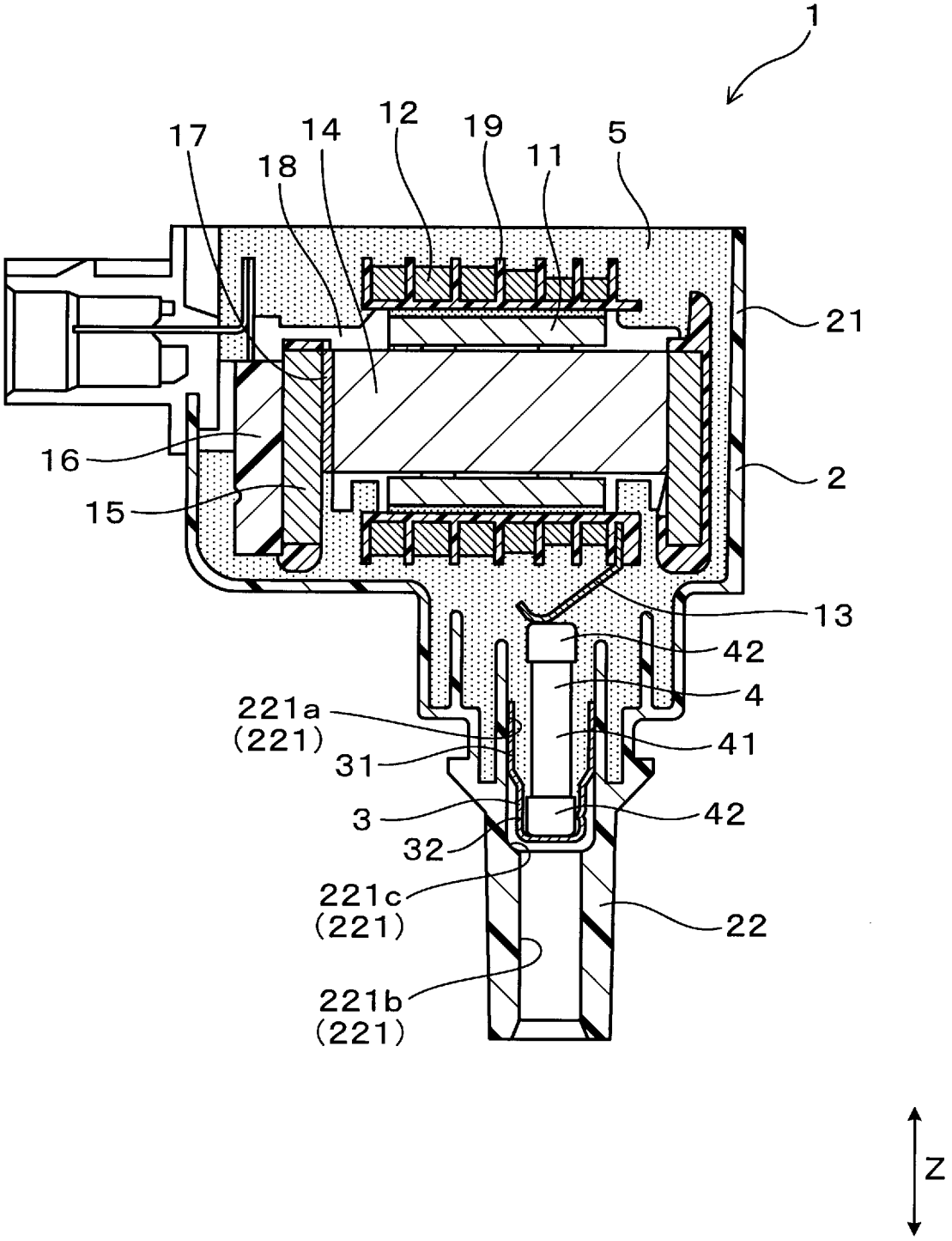
FIG. 1 is a sectional view which illustrates an ignition coil for internal combustion engines according to the first embodiment.

The ignition coil 1, as clearly illustrated in FIG. 1, includes the primary coil 11, the secondary coil 12, the case 2, the high-voltage terminal 3, the resistor 4, and the filled resin 15. The primary coil 11 and the secondary coil 12 are magnetically coupled together. The case 2 includes the case body 21 in which the primary coil 11 and the secondary coil 12 are disposed and the hollow cylindrical high-voltage tower 22 protruding or extending downward from the case body 21. The high-voltage terminal 3 is press-fit in the high-voltage tower 22 to close the inside of the high-voltage tower 22. The resistor 4 is fit in the high-voltage terminal 3. The filled resin 15 is disposed in the case body 21 and hermetically seal the primary coil 11, the secondary coil 12, and the resistor 4.

Figure 2:
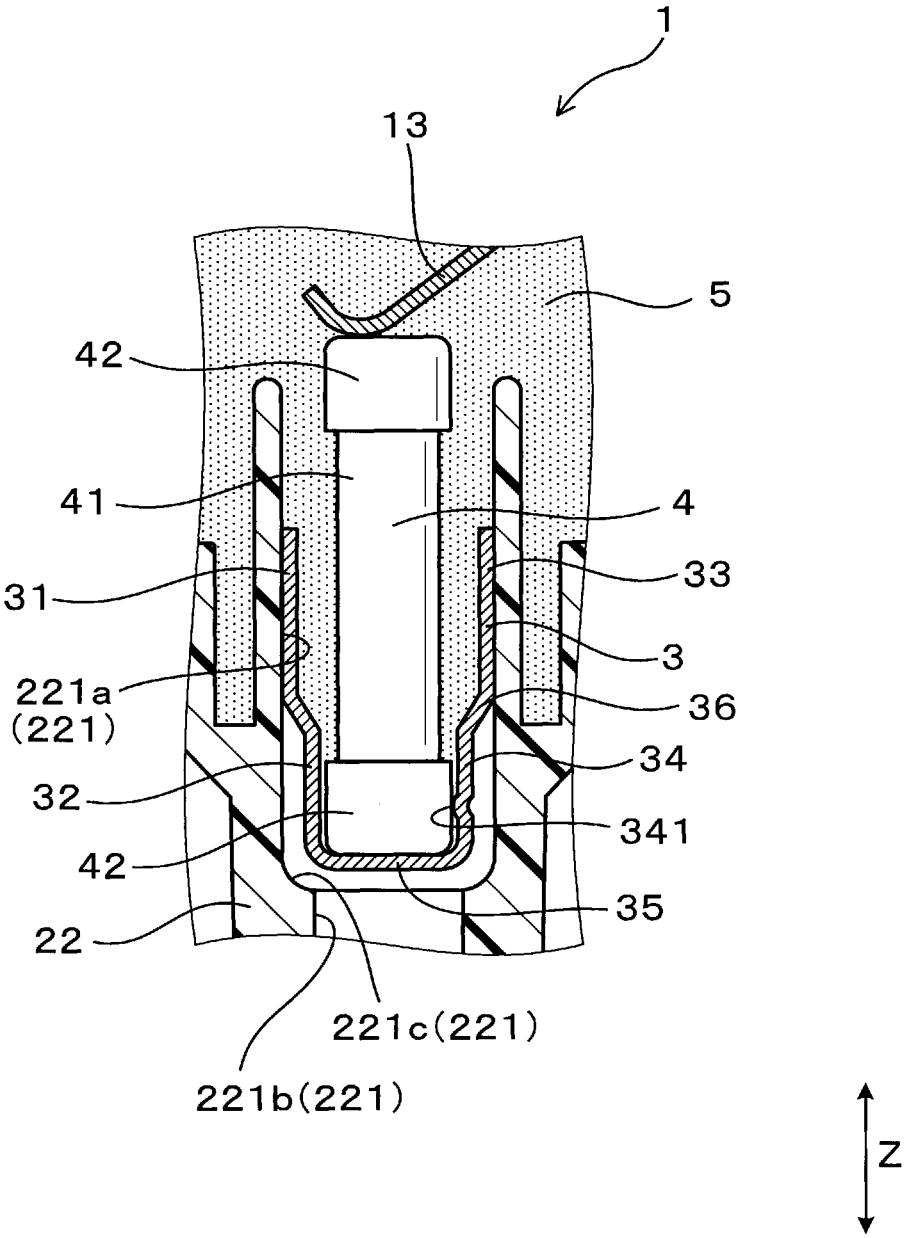
FIG. 2 is an enlarged view which illustrates a region around a resistor of the ignition coil in FIG. 1.

The high-voltage terminal 3, as clearly illustrated in FIG. 2, has a hollow cylindrical peripheral wall (i.e., a side wall) extending in the vertical direction Z. The peripheral wall of the high-voltage terminal 3 includes the pressed wall 31 and the non-pressed wall 32 which is adjacent the pressed wall 31 in the vertical direction Z. The vertical direction Z, as referred to herein, is a longitudinal direction of the high-voltage tower 22. The pressed wall 31 occupies a portion of the peripheral wall of the high-voltage terminal 3 and is placed in pressed contact with the high-voltage tower 22. The non-pressed wall 32 occupies another portion of the peripheral wall of the high-voltage terminal 3 and is not pressed against or placed in non-contact with the high-voltage tower 22. The resistor 4 is fit in the non-pressed wall 32.

The structure of the ignition coil 1 will be described below in detail.

In this disclosure, the vertical direction Z is, as described above, a direction in which the high-voltage tower 22 protrudes from the case body 21. A region where the high-voltage tower 22 protrudes from the case body 21 in the vertical direction Z will also be referred to below as a lower side. The opposite side will also be referred to below as an upper side. "upper" or "lower" is used for the sake of convenience and not limited to orientation of the ignition coil 1 relative to the vertical direction.

In use, the ignition coil 1 is connected to a spark plug mounted in an internal combustion engine for automotive vehicles or cogeneration systems and works to apply high-voltage to the spark plug.

The primary coil 11 and the secondary coil 12 are, as can be seen in FIG. 1, arranged coaxially with each other. The primary coil 11 is disposed inside the secondary coil 12 in a radial direction thereof. Component parts of the ignition coil 1, such as the primary coil 11 and the secondary coil 12, are hermetically sealed by the filled resin 15 in the case body 21. The filled resin 15 is made from epoxy resin.

The case 2 is made of PBT (Poly Butylene Terephtalate) resin. The case body 21, as illustrated in FIG. 1, opens upward, so that an upper surface of the filled resin 15 disposed inside the case 2 is exposed upward outside the case body 21.

The high-voltage tower 22 is of a hollow cylindrical shape and has a through hole extending therethrough in the vertical direction Z. The high-voltage tower 22 has the inner peripheral surface 221 formed therein. The inner peripheral surface 221 includes portions which are arranged in the vertical direction Z and different in inner diameter from each other. Specifically, the inner peripheral surface 221 of the high-voltage tower 22 includes the lower inner tower surface 221*b* and the upper inner tower surface 221*a*. The lower inner tower surface 221*b* is arranged below the upper inner tower surface 221*a* in the vertical direction Z. The upper inner tower surface 221*a* is greater in inner diameter than the lower inner tower surface 221*b*. The inner peripheral surface 221 of the high-voltage tower 22 also includes the inner tower shoulder 221*c* lying between the lower inner tower surface 221*b* and the upper inner tower surface 221*a*.

The high-voltage terminal 3 is, as illustrated in FIGS. 1 and 2, press-fit in the upper inner tower surface 221*a* of the high-voltage tower 22. The high-voltage terminal 3, as clearly illustrated in FIGS. 2, 3, and 5, has a given length which includes the upper cylindrical portion 33, the lower cylindrical portion 34, the bottom 35, and the connecting cylindrical portion 36. The upper cylindrical portion 33 is of a hollow cylindrical shape extending in the vertical direction Z. The lower cylindrical portion 34 is smaller in diameter than the upper cylindrical portion 33. The lower cylindrical portion 34 extends in the vertical direction Z and is located below the upper cylindrical portion 33. The lower cylindrical portion 34 is of a hollow cylindrical shape extending in the vertical direction Z. The bottom 35 closes a lower end of the lower cylindrical portion 34. The connecting cylindrical portion 36 extends or connects between a lower end of the upper cylindrical portion 33 and an upper end of the lower cylindrical portion 34. The connecting cylindrical portion 36 tapers downward to have a diameter decreasing as approaching the upper end of the lower cylindrical portion 34.

The high-voltage terminal 3, as can be seen in FIG. 2, has the upper cylindrical portion 33 is press-fit on the upper inner tower surface 221*a* of the high-voltage tower 22. In other words, the upper cylindrical portion 33 constitutes the pressed wall 31. The connecting cylindrical portion 36, the lower cylindrical portion 34, and the bottom 35 constitute the non-pressed wall 32. The upper cylindrical portion 33 has an entire circumference thereof pressed against the upper inner tower surface 221*a*. The high-voltage terminal 3 serves as a stopper or plug to block the filled resin 15 from leaking downward from the high-voltage tower 22.

Although not illustrated, the upper inner tower surface 221*a* of the high-voltage tower 22 has a positioning portion(s) which contacts the connecting cylindrical portion 36 of the high-voltage terminal 3. Specifically, the positioning portion is implemented by a protrusion which is formed on the inner surface of the high-voltage tower 22 and bulges in the radial direction of the high-voltage tower 22 between the lower cylindrical portion 34 and the upper cylindrical portion 33 of the high-voltage terminal 3. This layout avoids a physical interference of the lower cylindrical portion 34 with the positioning portion when the high-voltage terminal 3 is press-fitted from above the high-voltage tower 22 inside the upper inner tower surface 221*a* of the high-voltage tower 22 and also achieves a mechanical interference of the connecting cylindrical portion 36 with the positioning portion in the vertical direction Z, thereby positioning the high-voltage terminal 3 relative to the high-voltage tower 22 in the vertical direction Z. The positioning portion may be shaped to extend continuously to the inner tower shoulder 221*c* of the high-voltage tower 22 in the vertical direction Z, but may alternatively be made into another configuration. The positioning may be formed on a circumferential portion of the inner peripheral surface 221 of the high-voltage tower 22 or alternatively be shaped to extend along an entire circumference of the inner peripheral surface 221 of the high-voltage tower 22. Instead of the positioning portion, the positioning of the high-voltage terminal 3 relative to the high-voltage tower 22 in the vertical direction Z may be achieved in another way.

Figure 3:
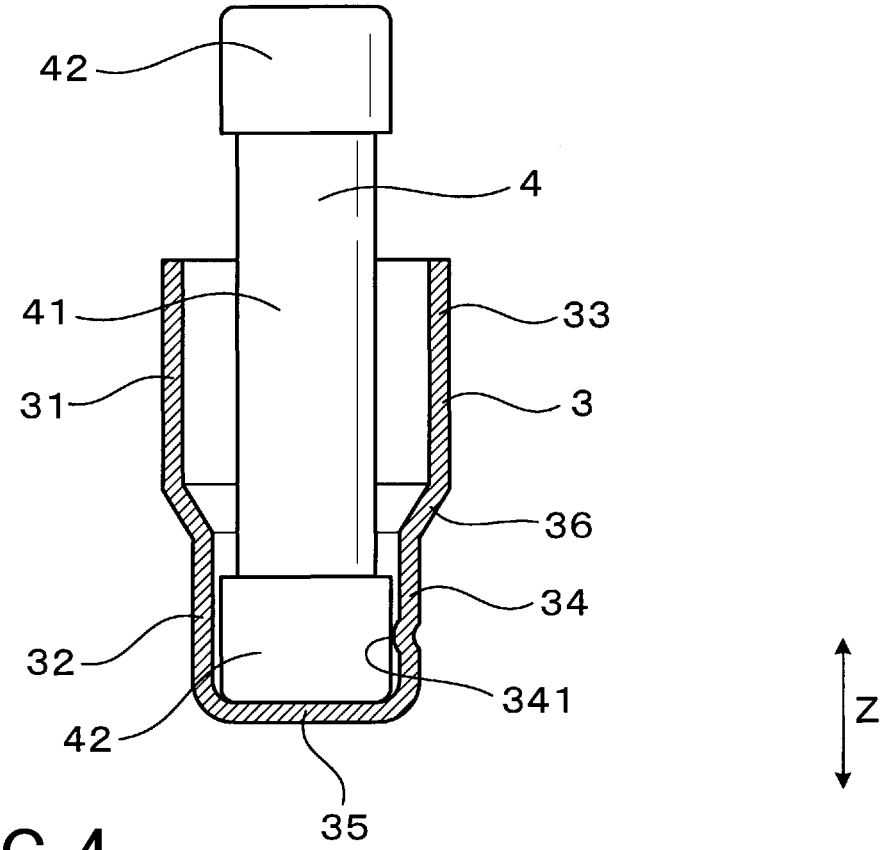
FIG. 3 is a partially sectional view which illustrates a high-voltage terminal and a resistor in the first embodiment.
Figure 4:
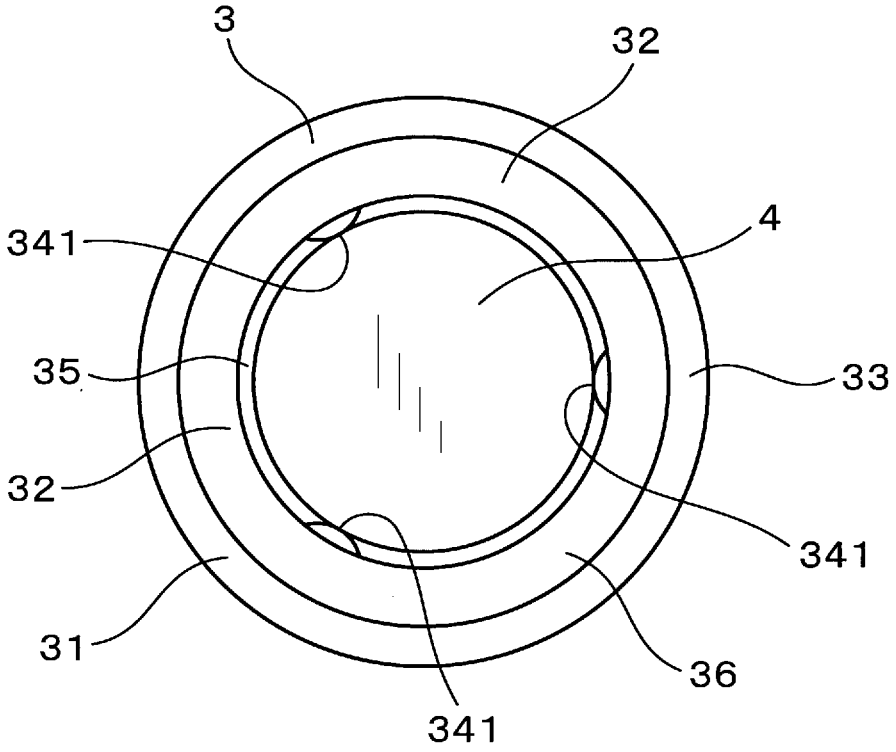
FIG. 4 is a plan view which illustrates a high-voltage terminal and a resistor in the first embodiment.
Figure 5:
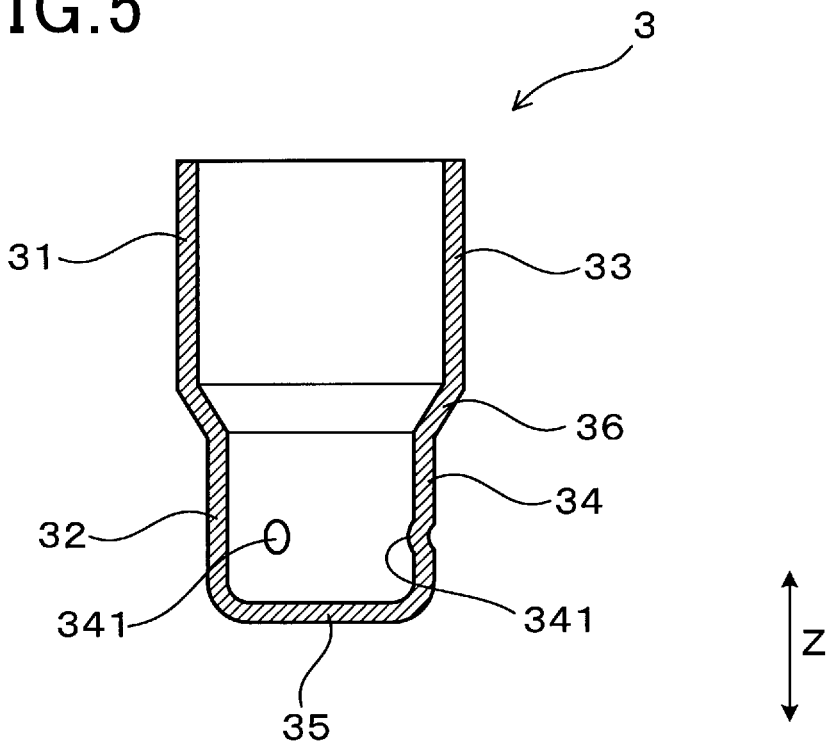
FIG. 5 is a sectional view which illustrates a high-voltage terminal in the first embodiment.

The lower cylindrical portion 34 which constitutes the non-pressed wall 32, as illustrated in FIGS. 2 to 5, has a plurality of inner protrusions 341 formed on the inner peripheral surface thereof. The protrusions 341 bulge inward from the inner peripheral surface of the lower cylindrical portion 34 and are placed in contact with the outer peripheral surface of the resistor 4. Each of the inner protrusions 341 is of a semi-spherical shape in cross section. The inner protrusions 341 are, as can be seen in FIG. 4, arranged away from each other in a circumferential direction of the high-voltage terminal 3. Specifically, the inner protrusions 341 are located at three places on the inner periphery of the high-voltage terminal 3 and at equal intervals away from each other in the circumferential direction of the high-voltage terminal 3. FIG. 5 partially represents the inner protrusions 341 for the brevity of illustration. The inner protrusions 341 are all located at the same level in the vertical direction Z, in other words, aligned with each other in the circumferential direction of the high-voltage terminal 3.

The resistor 4 is, as can be seen in FIGS. 2 and 4, press-fit in the lower cylindrical portion 34. Specifically, the resistor 4 is, as illustrated in FIG. 4, press-fit on all the inner protrusions 341 of the lower cylindrical portion 34.

The resistor 4, as illustrated in FIGS. 2 and 3, includes the resistor body 41 and a pair of electrode caps 42 disposed on upper and lower ends of the resistor body 41. The resistor body 41 is formed by ceramic in a cylindrical shape, but may be designed in another configuration. For instance, the resistor body 41 may be made of a wire winding. The resistor body 41 is shaped to have an outer diameter kept constant in the vertical direction Z. The electrode caps 42 are each made by pressing a metallic plate into a cup shape. The resistor 4 has upper and lower end portions on which the electrode caps 42 are fit and which have an outer diameter greater than that of the remaining portion thereof. The resistor 4 is, as illustrated in FIGS. 2 to 4, press-fit at a lower one of the electrode caps 42 in the lower cylindrical portion 34 of the high-voltage terminal 3 so that it is pressed against all the inner protrusions 341 of the high-voltage terminal 3. The resistor 4 has a bottom surface placed in contact with the upper surface of the bottom 35 of the high-voltage terminal 3.

The resistor 4, as can be seen in FIG. 3, has a major portion which is other than portions of the lower electrode cap 42 press-fit on the inner protrusions 341 of the high-voltage terminal 3 and the lower end thereof contacting the bottom 35 of the high-voltage terminal 3 and which faces the inner peripheral surface of the high-voltage terminal 3 through an air gap. For instance, the inner diameter of the upper cylindrical portion 33 constituting the pressed wall 31 is greater than the outer dimeter of the resistor 4, thereby creating the air gap between the resistor 4 and the pressed wall 31.

The above air gap between the major portion of the resistor 4 and the inner periphery of the high-voltage terminal 3 is filled with the resin 5. At least an entire circumference of the major portion of the resistor 4 is covered with the filled resin 5. In this embodiment, the entire circumference of the resistor 4 including the electrode caps 42 is covered with the filled resin 5.

The upper cylindrical portion 33, as illustrated in FIGS. 2 and 3, has the upper end located below and away from the upper electrode cap 42 of the resistor 4 in the vertical direction Z. Specifically, the upper end of the upper cylindrical portion 33 lies adjacent a middle portion of a length of the resistor body 41 in the radial direction of the upper cylindrical portion 33, thereby creating an air gap between the upper electrode cap 42 of the resistor 4 and the high-voltage terminal 3.

The lower electrode cap 42 of the resistor 4 is electrically connected to a spark plug, not shown, through the high-voltage terminal 3. The upper electrode cap 42 of the resistor 4 is, as clearly illustrated in FIG. 1, electrically connected to the secondary coil 12 through the connector terminal 13. The resistor 4 works to minimize noise current flowing from the spark plug joined to the ignition coil 1.

The component parts of the ignition coil 1, as illustrated in FIG. 1, include the center core 14, the outer core 15, the igniter 16, the magnet 17, the primary bobbin 18, and the secondary bobbin 19. The center core 14 is arranged inside the primary coil 11 and the secondary coil 12 and made from soft magnetic material. The outer core 15 surrounds the primary coil 11 and the secondary coil 12 in a direction perpendicular to the vertical direction Z and is made from soft magnetic material. The igniter 16 works to electrically energize or deenergize the primary coil 11. The magnet 17 applies a magnetic bias to the center core 14 in order to enhance an output voltage from the ignition coil 1 and increases a change in magnetic flux upon deenergization of the primary coil 11 to increase voltage developed at the secondary coil 12. The primary bobbin 18 has the primary coil 11 wound therearound and is made from resin. The secondary bobbin 19 has the secondary coil 12 wound therearound and is made from resin.

The operation and beneficial advantages of this embodiment will be described below.

The ignition coil 1 in this embodiment has the high-voltage terminal 3 which has a portion (i.e., the pressed wall 31) of length thereof pressed against the high-voltage tower 22. The high-voltage terminal 3 is press-fit at the pressed wall 31 in the high-voltage tower 22, so that it is firmly retained by the high-voltage tower 22. The high-voltage terminal 3 has the non-pressed wall 32 discrete from the pressed wall 31 in the vertical direction Z. The resistor 4 is fit in the non-pressed wall 32. This minimizes the pressure which results from the press-fit of the high-voltage terminal 3 in the high-voltage tower 22 and acts on the resistor 4. This enables a length of the pressed wall 31 press-fit in the high-voltage tower 22 to be increased in the vertical direction Z, which results in an increase in area of contact between the high-voltage tower 22 and the high-voltage terminal 3. The pressed wall 31 which has an increased area is, therefore, capable of bearing the pressure exerted by the high-voltage tower 22 on the high-voltage terminal 3, thereby ensuring a desired mechanical strength of the high-voltage tower 22 and the high-voltage terminal 3. Further, the increased area of contact between the high-voltage tower 22 and the high-voltage terminal 3 enhances the degree of hermetical sealing between the high-voltage tower 22 and the high-voltage terminal 3, thereby minimizing the leakage of the filled resin 5 from the case 2.

The resistor 4 is, as described above, fit in the non-pressed wall 32, not the pressed wall 31, thereby eliminating the need for increasing a mechanical strength of a structural combination of the pressed wall 31 of the high-voltage terminal 3 and the resistor 4, which avoids exertion of a large degree of pressure from the pressed wall 31 on the high-voltage tower 22.

The pressed wall 31 has the inner diameter greater than the outer diameter of the resistor 4, thereby preventing the pressed wall 31 from physically interfering with the resistor 4 which will produce stress between the resistor 4 and the pressed wall 31.

The high-voltage terminal 3 is, as described above, made up of the upper cylindrical portion 33, the connecting cylindrical portion 36, the lower cylindrical portion 34, and the bottom 35. The upper cylindrical portion 33 constitutes the pressed wall 31. The resistor 4 is fit in the lower cylindrical portion 34. This enables the high-voltage terminal 3 which, as described above, contributes to a decrease in pressure acting on the resistor 4 and the high-voltage tower 22 to be shaped in a simple form, thereby enhancing the productivity of the high-voltage terminal 3.

The non-pressed wall 32, as described above, has the inner protrusions 341 formed on the inner periphery thereof. The inner protrusions 341 bulge inward and are placed in direct contact with the outer periphery of the resistor 4, thereby decreasing pressure required to press-fitting the resistor 4 into the high-voltage terminal 3 and ensuring the stability of electrical conductivity between the high-voltage terminal 3 and the resistor 4.

As apparent from the above discussion, the ignition coil 1 in this embodiment is capable of decreasing pressure acting on the resistor 4 and the high-voltage tower 22.

Second Embodiment

Figure 6:
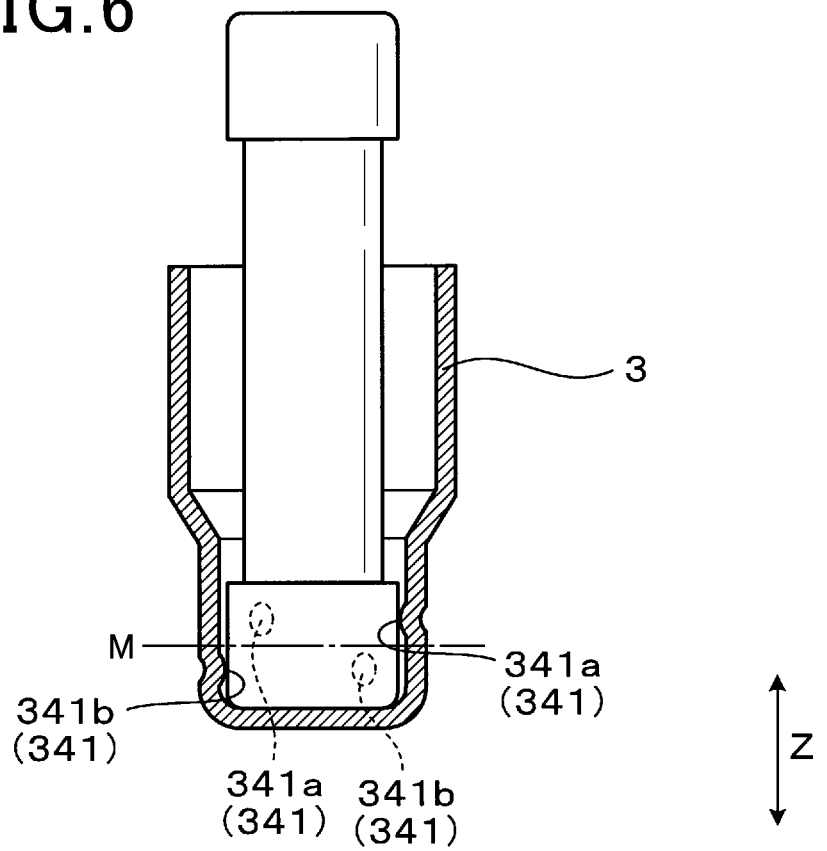
FIG. 6 is a partially sectional view which illustrates a high-voltage terminal and a resistor in the second embodiment.
Figure 7:
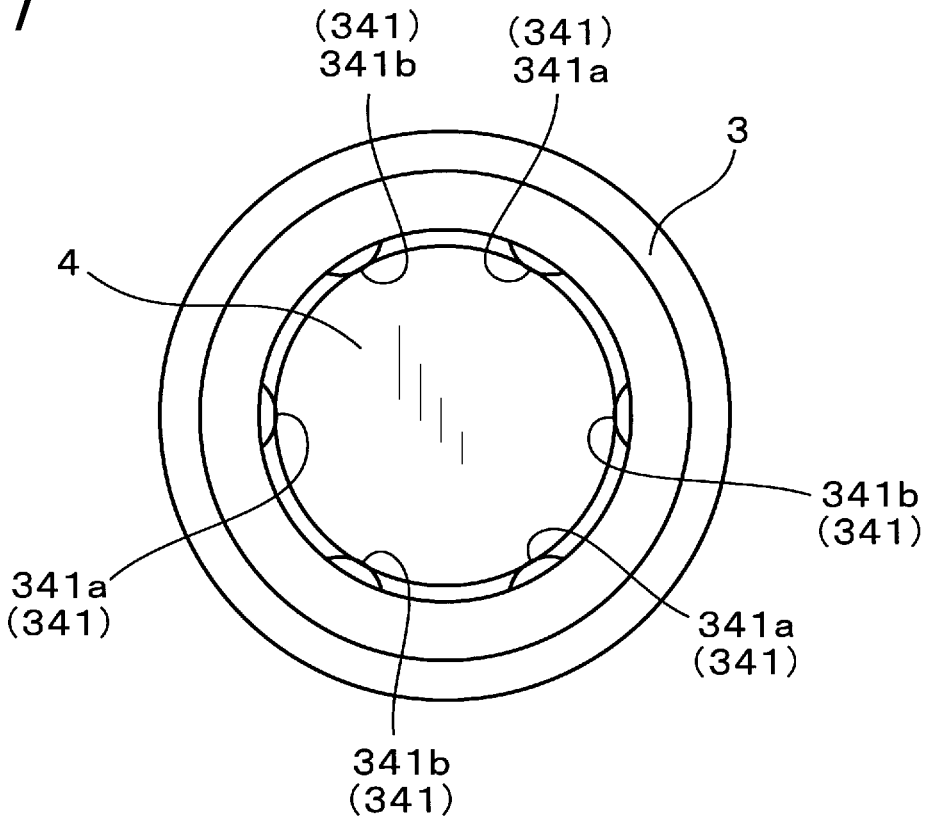
FIG. 7 is a plan view which illustrates a high-voltage terminal and a resistor in the second embodiment.

FIGS. 6 and 7 illustrates high-voltage terminal 3 according to the second embodiment which has a plurality of inner protrusions 341 offset from each other in the vertical direction Z.

Specifically, the high-voltage terminal 3, as illustrated in FIG. 7, has the six inner protrusions 341 which are arranged at equal intervals away from each other in the circumferential direction of the high-voltage terminal 3. The high-voltage terminal 3 of this embodiment, as clearly illustrated in FIG. 6, has two arrays: an upper and a lower array of the inner protrusions 341. Specifically, the upper array includes the three inner protrusions 341 which will also be referred to below as upper inner protrusions 341*a*. The lower array includes the three inner protrusions 341 which will also be referred to below as lower inner protrusions 341*b*. The upper and lower arrays are arranged away from each other in the vertical direction Z.

The upper inner protrusions 341*a* and the lower inner protrusions 341*b* are, as clearly illustrated in FIG. 6, arranged alternately in the circumferential direction of the high-voltage terminal 3. The upper inner protrusions 341*a* are, as can be seen in FIG. 6, disposed on the upper side of the center line M, while the lower inner protrusions 341*b* are disposed on the lower side of the center line M. The center line M is defined to extend in a direction perpendicular to the vertical direction Z and pass through the middle of the high-voltage terminal 3 between an upper and a lower end opposed to each other in the vertical direction Z.

Other arrangements are identical with those in the first embodiment.

In the second embodiment and following embodiments, the same or similar reference numbers as employed in the first or preceding embodiments refer to the same or similar parts unless otherwise specified.

The second embodiment offers substantially the same other beneficial advantages as those in the first embodiment.

The high-voltage terminal 3 of this embodiment is, as described above, equipped with a plurality of arrays of the inner protrusions 341 which are arranged away from each other in the vertical direction Z, thereby minimizing undesirable movement of the resistor 4 relative to the high-voltage terminal 3. In other words, the high-voltage terminal 3 firmly holds the resistor 4 at a plurality of points located away from each other in the vertical direction Z, thereby ensuring the stability of securement of the resistor 4 to the high-voltage terminal 3.

Third Embodiment

Figure 8:
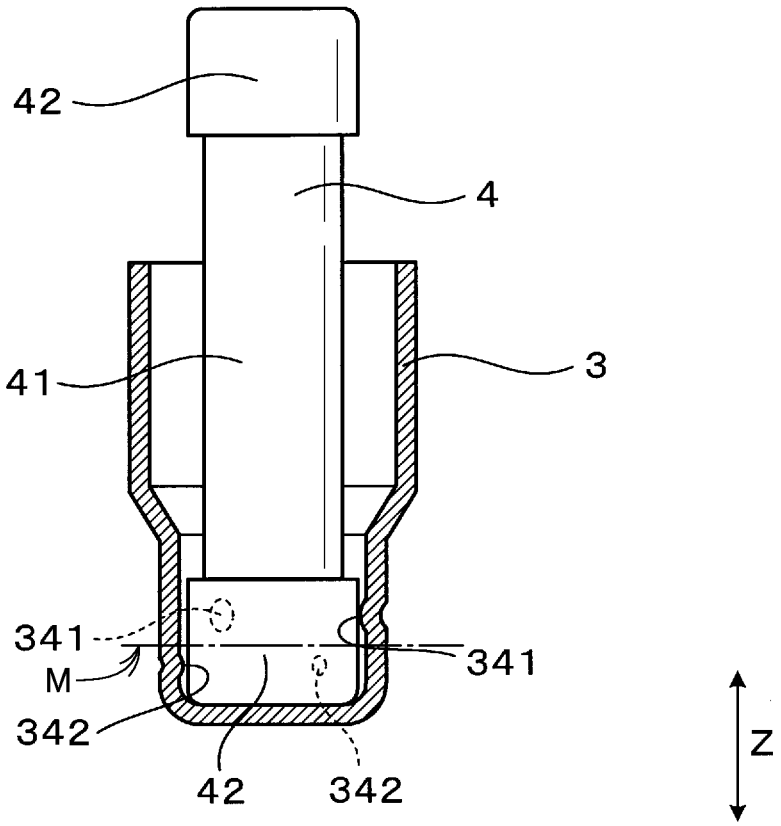
FIG. 8 is a partially sectional view which illustrates a high-voltage terminal and a resistor in the third embodiment.
Figure 9:
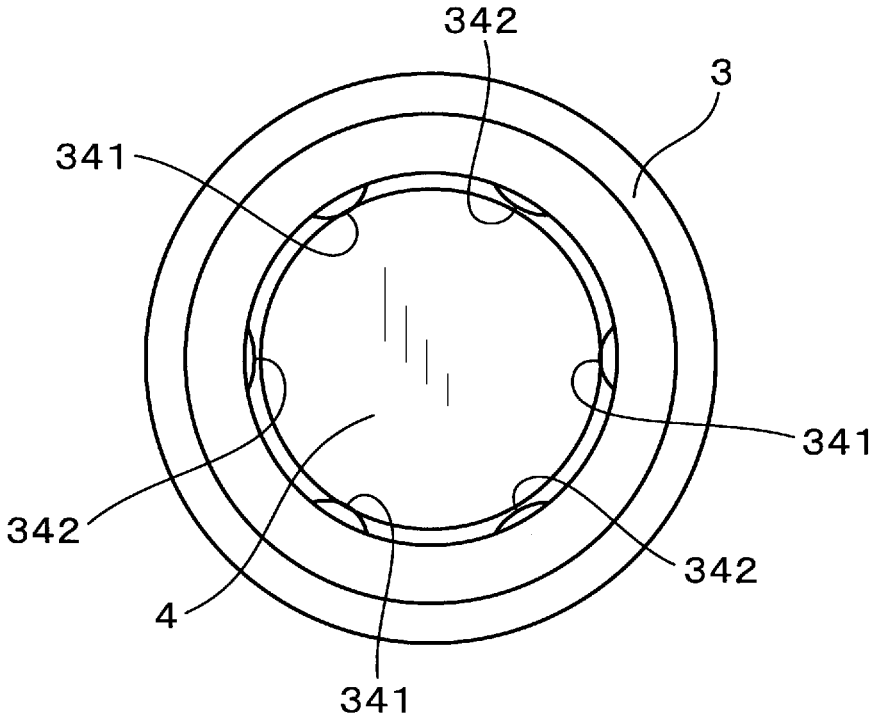
FIG. 9 is a plan view which illustrates a high-voltage terminal and a resistor in the third embodiment.

FIGS. 8 and 9 illustrate the high-voltage terminal 3 according to the third embodiment.

The high-voltage terminal 3 has the non-contact protrusions 342 formed on the inner peripheral surface thereof. The non-contact protrusions 342 bulge inward in the radial direction of the high-voltage terminal 3 and are placed in non-contact with the outer periphery of the resistor 4.

The non-contact protrusions 342 are offset from at least one of the inner protrusions 341 in the vertical direction Z.

The non-contact protrusions 342 are, as can be seen in FIG. 9, arranged at three places at equal intervals away from each other in the circumferential direction of the high-voltage terminal 3. All the non-contact protrusions 342 are offset from all the inner protrusions 341 in the circumferential direction. The non-contact protrusions 342 and the inner protrusions 341 are arranged alternately in the circumferential direction. All the non-contact protrusions 342 and all the inner protrusions 341 are located at equal intervals away from each other in the circumferential direction of the high-voltage terminal 3.

The inner protrusions 341 are, as illustrated in FIG. 8, arranged above the center line M of the high-voltage terminal 3 in the vertical direction Z. The center line M is defined in the same way as discussed in FIG. 6. The inner protrusions 341 are all located at the same level in the vertical direction Z. In other words, the inner protrusions 341 are all aligned with each other in the circumferential direction of the high-voltage terminal 3. The non-contact protrusions 342 are all arranged below the center line M in the vertical direction Z. The non-contact protrusions 342 are all located at the same level in the vertical direction Z. In other words, the non-contact protrusions 342 are all aligned with each other in the circumferential direction of the high-voltage terminal 3.

The non-contact protrusions 342 are, as can be seen in FIGS. 8 and 9, similar in shape to the inner protrusions 341, but however, a degree to which the non-contact protrusions 342 bulge in the radial direction of the high-voltage terminal 3 is less than that to which the inner protrusions 341 bulge in the radial direction of the high-voltage terminal 3. In other words, the non-contact protrusions 342 have apexes located outside an inscribed circle of the inner protrusions 341 in the radial direction of the high-voltage terminal 3.

Other arrangements are identical with those in the first embodiment.

The high-voltage terminal 3 of this embodiment is, as described above, equipped with the non-contact protrusions 342 which bulge inward and are located away from the outer periphery of the resistor 4. The non-contact protrusions 342 are offset from at least one of the inner protrusions 341 in the vertical direction Z. The non-contact protrusions 342 serve to achieve physical interference of the outer periphery of the resistor 4 with the non-contact protrusions 342 when the resistor 4 is tilted relative to the high-voltage terminal 3, thereby minimizing such tilt of the resistor 4.

The third embodiment offers substantially the same beneficial advantages as those in the first embodiment.

Fourth Embodiment

Figure 10:
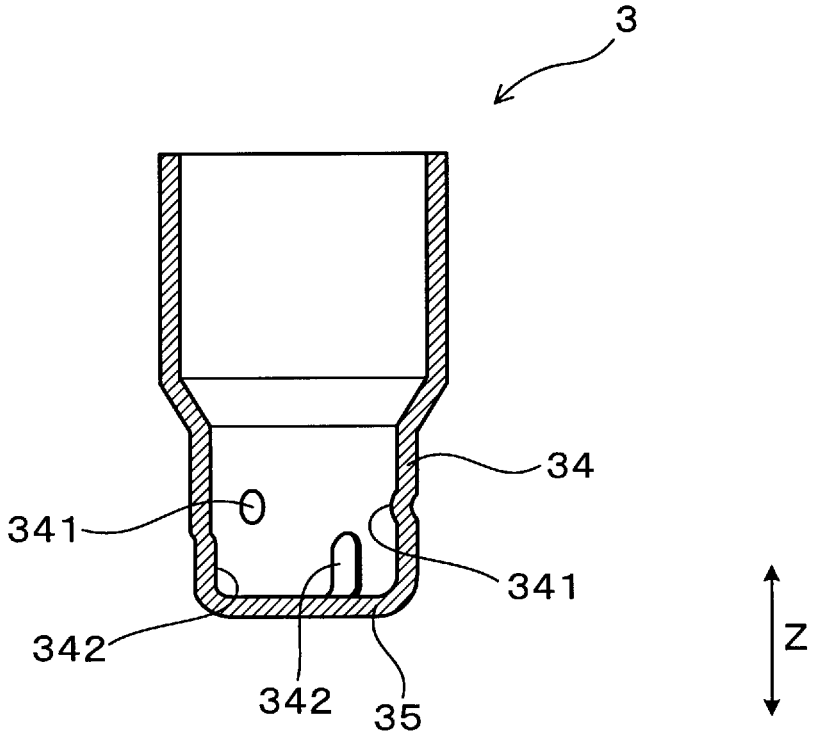
FIG. 10 is a partially sectional view which illustrates a high-voltage terminal in the fourth embodiment.

FIG. 10 illustrates high-voltage terminal 3 according to the fourth embodiment which is different in configuration of the non-contact protrusions 342 from the third embodiment.

Specifically, each of the non-contact protrusions 342 is formed in an elongated shape and bulges inward from the inner periphery of the high-voltage terminal 3. Each of the non-contact portions 342 has a length extending in the vertical direction Z. More specifically, each of the non-contact protrusions 424 extends from the bottom 35 of the high-voltage terminal 3 to substantially the middle of the lower cylindrical portion 34 in the vertical direction Z.

Other arrangements are identical with those in the third embodiment.

The fourth embodiment offers substantially the same beneficial advantages as those in the third embodiment.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

For instance, the inner protrusions 341 in the first to fourth embodiments may be, like the non-contact protrusion 342 in the fourth embodiment, shaped to have a length elongated in the vertical direction Z. The connecting cylindrical portion 36 in the first to fourth embodiments is designed to have a diameter decreasing downward, but however, the high-voltage terminal 3 may alternatively be shaped to have a shoulder which connects between the lower end of the upper cylindrical portion 33 and the upper end of the lower cylindrical portion 34 and extends substantially perpendicular to the vertical direction Z instead of the connecting cylindrical portion 36. In this case, the high-voltage tower 22 may have formed on the inner periphery thereof an inner shoulder which is contactable with the shoulder of the high-voltage terminal 3 in the vertical direction Z, thereby minimizing a variation in location of the high-voltage terminal 3 relative to the high-voltage tower 22 in the vertical direction Z. The connecting cylindrical portion 36 may alternatively be curved.

What is claimed is:

1. An ignition coil for an internal combustion engine comprising:

a primary coil and a secondary coil which are magnetically coupled with each other;

a case which includes a case body in which the primary and secondary coils are disposed and a high-voltage tower which is of a hollow cylindrical shape and extends downward from the case body;

a high-voltage terminal which is press-fit in the high-voltage tower to close an inside of the high-voltage tower, the high-voltage terminal being of a hollow cylindrical shape with a bottom and an upper opening facing upward;

a resistor which is fit in the high-voltage terminal; and a filled resin which is disposed inside the case body and hermetically seals the primary and secondary coils, wherein the high-voltage terminal includes a pressed wall and a non-pressed wall which are arranged adjacent each other in a vertical direction, the pressed wall being pressed against the high-voltage tower, the non-pressed wall being not pressed against the high-voltage tower, and wherein the resistor is fit in the non-pressed wall.

2. An ignition coil for an internal combustion engine as set forth in claim 1, wherein the pressed wall has an inner diameter greater than an outer diameter of the resistor.

3. An ignition coil for an internal combustion engine as set forth in claim 1, wherein the high-voltage terminal has a length which extends in the vertical direction and includes an upper cylindrical portion, a lower cylindrical portion, a bottom, and a connecting cylindrical portion, the upper cylindrical portion being of a hollow cylindrical shape, the lower cylindrical portion being smaller in diameter than the upper cylindrical portion and extending below in the vertical direction, the bottom closing a lower end of the lower cylindrical portion, the connecting cylindrical portion connecting between a lower end of the upper cylindrical portion and an upper end of the lower cylindrical portion, and wherein the upper cylindrical portion constitutes the pressed wall, the connecting cylindrical portion, the lower cylindrical portion, and the bottom constituting the non-pressed wall, the resistor being fit in the lower cylindrical portion.

4. An ignition coil for an internal combustion engine as set forth in claim 1, wherein the non-pressed wall has formed on an inner peripheral surface thereof inner protrusions which bulge inward and are placed in contact with an outer peripheral surface of the resistor.

5. An ignition coil for an internal combustion engine as set forth in claim 4, wherein the high-voltage terminal has formed on an inner peripheral surface thereof the inner protrusions which are arranged in a circumferential direction of the high-voltage terminal, and wherein the inner protrusions are located at a plurality of places on the inner peripheral surface of the high-voltage terminal and arranged in the vertical direction.

6. An ignition coil for an internal combustion engine as set forth in claim 4, wherein the high-voltage terminal has formed on the inner peripheral surface thereof non-contact protrusions which bulge inward and are placed in non-contact with the outer peripheral surface of the resistor, and wherein the non-contact protrusions are offset from at least one of the inner protrusions in the vertical direction.

7. An ignition coil for an internal combustion engine as set forth in claim 1, wherein:

the pressed wall forms an upper hollow cylindrical shape; and the non-pressed wall forms a lower hollow cylindrical shape that extends below the upper hollow cylindrical shape in the vertical direction and has a smaller diameter than that of the upper hollow cylindrical shape.

8. An ignition coil for an internal combustion engine as set forth in claim 1, wherein the high-voltage terminal has formed on an inner peripheral surface thereof an upper plurality of inner protrusions and a lower plurality of inner protrusions, the upper plurality of inner protrusions being offset from the lower plurality of inner protrusions in the vertical direction.

9. An ignition coil for an internal combustion engine as set forth in claim 8, wherein the upper plurality of inner protrusions and the lower plurality of inner protrusions are formed on the non-pressed wall of the high-voltage terminal.

10. An ignition coil for an internal combustion engine as set forth in claim 8, wherein the upper plurality of inner protrusions and the lower plurality of inner protrusions contact the resistor.

11. An ignition coil for an internal combustion engine as set forth in claim 8, wherein one of the upper plurality of inner protrusions and the lower plurality of inner protrusions contact the resistor and the other of the upper plurality of inner protrusions and the lower plurality of inner protrusions do not contact the resistor.

* * * * *